US011763964B2

(12) United States Patent
Hori

(10) Patent No.: US 11,763,964 B2
(45) Date of Patent: Sep. 19, 2023

(54) ELECTRICALLY INSULATED CABLE AND HARNESS INTEGRATED WITH SENSOR

(71) Applicant: SUMITOMO ELECTRIC INDUSTRIES, LTD., Osaka (JP)

(72) Inventor: Kenji Hori, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 326 days.

(21) Appl. No.: 17/270,999

(22) PCT Filed: Aug. 20, 2020

(86) PCT No.: PCT/JP2020/031429
§ 371 (c)(1),
(2) Date: Feb. 24, 2021

(87) PCT Pub. No.: WO2021/039576
PCT Pub. Date: Mar. 4, 2021

(65) Prior Publication Data

US 2022/0310286 A1 Sep. 29, 2022

(30) Foreign Application Priority Data

Aug. 30, 2019 (JP) ..... 2019-158560

(51) Int. Cl.
*H01B 7/282* (2006.01)
*H01B 7/02* (2006.01)

(52) U.S. Cl.
CPC ..... *H01B 7/282* (2013.01); *H01B 7/02* (2013.01)

(58) Field of Classification Search
None
See application file for complete search history.

(56) References Cited

U.S. PATENT DOCUMENTS

| | | | | |
|---|---|---|---|---|
| 3,315,025 | A * | 4/1967 | Tomlinson | H01B 11/1839 156/54 |
| 6,064,002 | A | 5/2000 | Hayami et al. | |
| 2009/0238957 | A1 | 9/2009 | Clancy | |
| 2013/0240239 | A1 | 9/2013 | Kimura et al. | |
| 2016/0254615 | A1 | 9/2016 | Sugita et al. | |
| 2017/0355883 | A1* | 12/2017 | Hayakawa | B60R 16/0207 |

FOREIGN PATENT DOCUMENTS

| | | |
|---|---|---|
| EP | 2784144 | 10/2014 |
| JP | H09-197221 | 7/1997 |
| JP | H10-177818 | 6/1998 |
| JP | 2000-030537 | 1/2000 |
| JP | 2005-050719 | 2/2005 |
| JP | 2016-162566 | 9/2016 |
| WO | 2008/078406 | 7/2008 |

* cited by examiner

*Primary Examiner* — Krystal Robinson
(74) *Attorney, Agent, or Firm* — IPUSA, PLLC

(57) ABSTRACT

An electrically insulated cable that is excellent in in adhesion with a resin used for resin sealing is provided. According to the present invention, an electrically insulated cable (10) includes: a plurality of coated electric wires (11) and a sheath (12) covering outer peripheries of the plurality of coated electric wires, wherein an average value of surface roughness Rz of an outer surface of the sheath is 15 μm or more and 75 μm or less.

5 Claims, 2 Drawing Sheets

ELECTRICALLY INSULATED CABLE AND HARNESS INTEGRATED WITH SENSOR

TECHNICAL FIELD

The present disclosure relates to an electrically insulated cable and a harness integrated with sensor.

The present application is based on and claims priority to Japanese Patent Application No. 2019-158560, filed on Aug. 30, 2019, the entire contents of the Japanese Patent Application being hereby incorporated herein by reference.

BACKGROUND ART

Patent Document 1 discloses an electric wire/cable having an outermost coating layer, wherein the outermost coating layer consists of a composition obtained by mixing 0.1 to 1.1 parts by weight of a crosslinking agent to 100 parts by weight of a blended polymer of 40 to 90 parts by weight of polyolefin having crystals having a thermal softening point of 150° C. or more and 5 to 60 parts by weight of soft polyolefin having Shore D hardness of 65. or less. Further, one or both of the polyolefin having crystals having a thermal softening point of 150° C. or more and the soft polyolefin having Shore D hardness of 65 or less are modified with maleic anhydride.

PRIOR ART DOCUMENT

Patent Document

[Patent Document 1] Japanese Laid-open Patent Publication No. 2000-030537

SUMMARY OF THE INVENTION

According to the present disclosure, an electrically insulated cable includes: a plurality of coated electric wires and a sheath covering outer peripheries of the plurality of coated electric wires, wherein an average value of surface roughness Rz of an outer surface of the sheath is 15 μm or more and 75 μm or less.

EMBODIMENT FOR CARRYING OUT THE INVENTION

Figure 1:
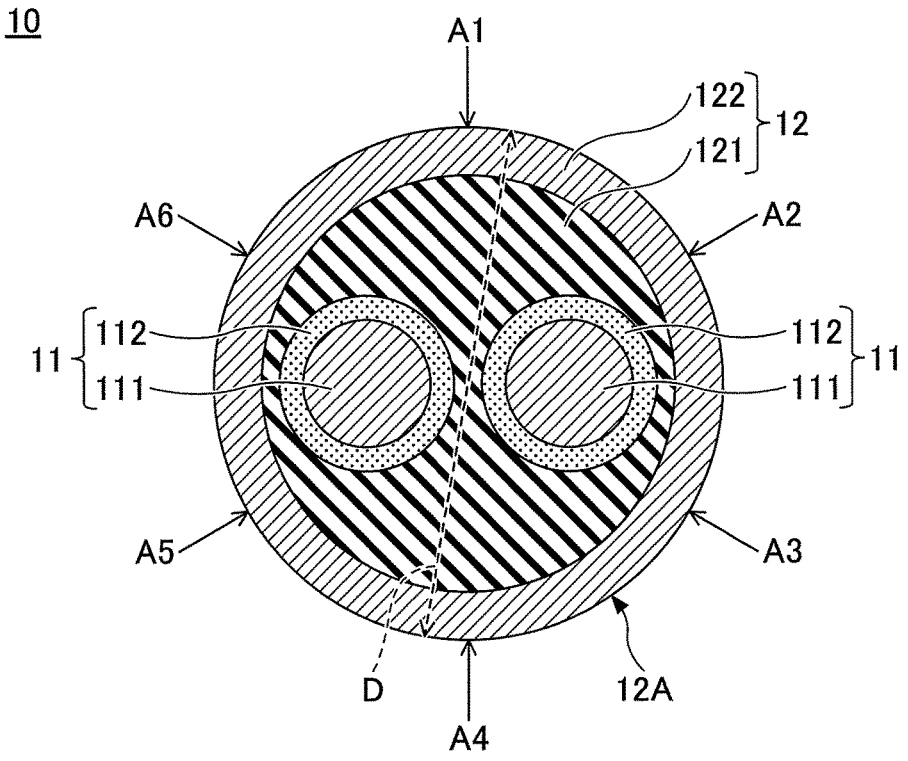
FIG. 1 is a cross-sectional view of an electrically insulated cable according to one aspect of the present disclosure in a plane perpendicular to the longitudinal direction.

Problem to be Solved by the Present Disclosure

Various sensors, such as wheel speed sensors, are mounted in automobiles or the like, and for example, an electrically insulated cable, such as electric wire/cable disclosed in Japanese Patent Application Laid-Open, is used for connecting a sensor and a control unit.

Various sensors mounted in automobiles or the like may be used in an environment where in contact with water or ice. Thus, in order to protect the sensor from water, after the sensor is connected to an end portion or an intermediate portion of the electrically insulated cable, at least a portion of the electrically insulated cable and the sensor are collectively resin-sealed.

However, in recent years, it is required to further enhance the waterproofing performance, and it is required to enhance the adhesion between a used for resin sealing and an electrically insulated cable.

Therefore, the present disclosure has an object to provide an electrically insulated cable that is excellent in adhesion with a resin used for resin sealing.

Effect of the Present Disclosure

According to the present disclosure, it is possible to provide an electrically insulated cable that is excellent in adhesion with a resin used for resin sealing.

DESCRIPTION OF EMBODIMENTS OF THE PRESENT DISCLOSURE

To begin with, aspects of the present disclosure are listed and described below. In the following description, the same reference characters are allotted to the same or corresponding elements and the same descriptions thereof are not repeated.

(1) According to one aspect of the present disclosure, an electrically insulated cable includes: a plurality of coated electric wires and a sheath covering outer peripheries of the plurality of coated electric wires, wherein an average value of surface roughness Rz of an outer surface of the sheath is 15 μm or more and 75 μm or less.

Conventionally, the outer surface of an electrically insulated cable, that is, the outer surface of a sheath is smoothed to enhance the appearance. However, according to consideration by the inventor of the present invention, by making the average value of the surface roughness Rz of the outer surface 12A of the sheath 12 to be 15 μm or more (see FIG. 1), it is possible to obtain an electrically insulated cable that is excellent in the adhesion with a resin used for resin sealing. This is because, by making the average value of surface roughness Rz of the outer surface 12A of the sheath 12 to be 15 μm or more, the area in contact with the resin used for the resin sealing can be increased and the adhesion can be increased.

It is preferable that the average value of surface roughness Rz of the outer surface 12A of the sheath 12 is less than or equal to 75 μm. By making the average value of the surface roughness Rz of the outer surface 12A of the sheath 12 greater than or equal to 75 μm, friction between other members or cables can be suppressed and the abrasion resistance can be enhanced. Also, by making the average value of the surface roughness Rz of the outer surface 12A of the sheath 12 to be 75 μm or less, dimensional accuracy can be enhanced, that is, deviation from dimensions set in advance can be suppressed. Further, it is possible to enhance the heat resistance and to suppress water from adsorbing on the outer surface of the electrically insulated cable 10.

The surface roughness Rz is defined in JIS B 0601 (2013), and may be referred to as the maximum height roughness.

The method of obtaining average value of the surface roughness Rz of the outer surface 12A of the sheath 12 is not particularly limited. For example, first, in a cross-section perpendicular to the longitudinal direction of the electrically insulated cable 10, the measurement point A1 to the measurement point A6 can be set such that the intervals between the six measurement points are equal along the circumferential direction of the outer circumference. Then, at each of the measurement point A1 to the measurement point A6, the surface roughness Rz can be measured along the longitudinal direction of the electrically insulated cable, and the average of the measured values at the six measurement points can be obtained as the average value of the surface roughness Rz of the outer surface 12A of the sheath 12 of the electrically insulated cable.

(2) An outer diameter may be greater than or equal to 3.0 mm and less than or equal to 6.0 mm.

By making the outer diameter greater than or equal to 3.0 mm, even in a case in which the surface roughness Rz of the outer surface of the sheath is large, the roughness of the surface is not noticeable and the appearance can be made favorable. Also, the dimensional accuracy can be enhanced.

In a case in which the outer diameter of the electrically insulated cable is 6.0 mm or less, the surface area of the outer surface of the sheath is normally small, and the adhesion with a resin used for resin sealing easily decreases. However, in the electrically insulated cable according to one aspect of the present disclosure, even in a case in which the outer diameter of the electrically insulated cable is 6.0 mm or less, the adhesion with the resin used for resin sealing can be enhanced, and thus, the electrically insulated cable can be particularly effective.

(3) When a peel test is performed on a fusion strength evaluation sample obtained by thermally fusing the outer surface of the sheath separated from the plurality of coated electric wires to a sheet of polybutylene terephthalate, a maximum peel strength is converted to a value per 1 cm of a width of a fusion surface between the sheath and the sheet of polybutylene terephthalate included in the fusion strength evaluation sample and the value is defined as a fusion strength of the sheath, and the fusion strength of the sheath may be 50 N/cm or more.

By making the fusion strength greater than or equal to 50 N/cm, the adhesion with a resin and the resin used for resin sealing can be sufficiently enhanced, and the waterproofness can be enhanced.

A harness integrated with sensor according to one aspect of the present disclosure can include the electrically insulated cable according to any one of (1) to (3); a sensor connected to the electrically insulated cable; and a housing that collectively seals at least a portion of the electrically insulated cable and the sensor.

Because the harness integrated with sensor according to one aspect of the present disclosure includes the electrically insulated cable described above, the adhesion between a resin used for the housing and the electrically insulated cable is excellent. Therefore, the harness integrated with sensor according to one aspect of the present disclosure is excellent in waterproofing of the sensor portion, and it is possible to suppress a failure or the like of the sensor 21 from occurring.

DETAILS OF EMBODIMENT OF THE PRESENT DISCLOSURE

Specific examples of an electrically insulated cable and a harness integrated with sensor according to one embodiment of the present disclosure (hereinafter referred to as "the present embodiment") will be described below with reference to the drawings. It should be noted that the present invention is not limited to these examples but is set forth in the claims and is intended to include all modifications within the meanings and the scope equivalent to the claims.

1. Electrically Insulated Cable

FIG. 1 illustrates a cross-section perpendicular to the longitudinal direction of an electrically insulated cable according to the present embodiment. As illustrated in FIG. 1, an electrically insulated cable 10 in the present embodiment can include a plurality of coated electric wires 11 and a sheath 12 that covers the outer peripheries of the plurality of coated electric wires 11.

Then, the average value of the surface roughness Rz of an outer surface 12A of the sheath 12 can be 15 μm or more and 75 μm or less.

The inventor of the present invention diligently investigated an electrically insulated cable that is excellent in the adhesion to a resin used for resin sealing, that is, a mold material. As a result, the inventor of the present invention found that the surface roughness Rz of the outer surface of an electrically insulated cable has a significant effect on the adhesion with a resin used for resin sealing, and completed the present invention.

(1) Members Included in Electrically Insulated Cable

Hereinafter, each member included in an electrically insulated cable according to the present embodiment will be described with reference to FIG. 1.

(1-1) Coated Electric Wire

The coated electric wire 11 can include conductors 111 and coating layers 112 covering the conductors 111.

(Conductor)

The conductors 111 can be composed of a single metal element wire or a plurality of metal element wires. In a case in which the conductors 111 include a plurality of metal element wires, the plurality of metal element wires may be twisted together. That is, in a case in which the conductors 111 include a plurality of metal element wires, the conductors 111 can be stranded wires of the plurality of metal element wires.

The conductors 111 can also have a circular shape as an outer shape in a cross-section perpendicular to the longitudinal direction. Conductors of which the outer shape is a circular shape can be formed by circular compression in the conductor diameter direction. The conductors 111 can also have surface irregularities along the outer shape of a plurality of metal element wires.

The material of the conductors 111 is not particularly limited, but, for example, it is possible to use one or more kinds of commonly used conductor materials selected from, for example, copper, soft copper, silver-plated soft copper, nickel-plated soft copper, tin-plated soft copper, and the like.

The cross-sectional area of the conductors 111 is not particularly limited, but can be, for example, 0.1 $mm^2$ or more and 0.4 $mm^2$ or less.

(Coating Layer)

Although the material of the coating layers 112 is not particularly limited, a polyolefin-based resin can be used. For example, as the material of the coating layers 112, other than low-density polyethylene (LDPE), linear low-density polyethylene (L-LDPE), or the like, a copolymer in which a monomer having another polarity other than α-olefin is introduced to provide flexibility to a resin, such as an ethylene-ethyl acrylate copolymer, an ethylene-methyl acrylate copolymer (EMA), or an ethylene-vinyl acetate copolymer (EVA), can be used.

The coating layers 112 can be electrically insulated by coating the outer surfaces of the conductors 111 with a uniform thickness by extrusion molding or the like. Also, it is preferable that the coating layers 112 as an insulating coating are cross-linked after being applied on the outer surfaces of the conductors 111, in order to enhance the heat-resistant deformation property to prevent the electrical insulation property from being decreased due to deformation when receiving an external force under a relatively high-temperature environment. Examples of the method of crosslinking include irradiation with ionizing radial rays (e.g., gamma rays and electron rays), and chemical crosslinking such as peroxide crosslinking and silane crosslinking. It should be noted that the coating layer 112 may be or may not be crosslinked, but is preferably crosslinked because crosslinking enhances the tensile strength and the heat resistance.

The coating layer 112 can also contain an additive, such as a flame retardant, an antioxidant, and a crosslinking agent, as needed.

In a case in which the coated electric wire 11 is halogen-free, a metal hydroxide such as magnesium hydroxide, a nitrogen-based flame retardant, antimony trioxide, a phosphorous-based flame retardant (red phosphorus, phosphate), or the like can be used as the flame retardant. Also, in a case in which the coated electric wire 11 is not halogen-free, a brominated flame retardant can be used as the flame retardant.

The electrically insulated cable 10 in the present embodiment can include a plurality of coated electric wires 11. The number of coated electric wires 11 included in the electrically insulated cable 10 according to the present embodiment is not particularly limited, and the number of wires can be a number as desired depending on a device to be connected or the like. The electrically insulated cable 10 in the present embodiment can include, for example, two or more coated electric wires 11.

The plurality of coated electric wires 11 included in the electrically insulated cable 10 of the present embodiment can also be twisted together.

(1-2) Sheath

The electrically insulated cable 10 in the present embodiment can include a sheath 12 that covers the outer peripheries of the plurality of coated electric wires 11.

Conventionally the outer surface of the electrically insulated cable 10, that is, the outer surface 12A of the sheath 12 is smoothed to enhance the appearance. However, according to consideration by the inventor of the present invention, by making the average value of the surface roughness Rz of the outer surface 12A of the sheath 12 to be 15 μm or more, it is possible to obtain an electrically insulated cable that is excellent in the adhesion with a resin used for resin sealing. This is because, by making the average value of surface roughness Rz of the outer surface 12A of the sheath 12 to be 15 μm or more, the area in contact with the resin used for the resin sealing can be increased and the adhesion can be increased.

It is preferable that the average value of the surface roughness Rz of the outer surface 12A of the sheath 12 is less than or equal to 75 μm. By making the average value of the surface roughness Rz of the outer surface 12A of the sheath 12 greater than or equal to 75 μm, friction between other members or cables can be suppressed and the abrasion resistance can be enhanced. Also, by making the average value of the surface roughness Rz of the outer surface 12A of the sheath 12 to be 75 μm or less, dimensional accuracy can be enhanced, that is, deviation from dimensions set in advance can be suppressed. Further, it is possible to enhance the heat resistance and to suppress water from adsorbing on the outer surface of the electrically insulated cable 10.

The average value of the surface roughness Rz of the outer surface 12A of the sheath 12 is more preferably 20 μm or more and 65 μm or less, and is further more preferably 25 μm or more and 60 μm or less.

The surface roughness Rz is defined in JIS B 0601 (2013), and may be referred to as the maximum height roughness.

The method of obtaining average value of the surface roughness Rz of the outer surface 12A of the sheath 12 is not particularly limited. For example, first, in a cross-section perpendicular to the longitudinal direction of the electrically insulated cable 10, the measurement point A1 to the measurement point A6 can be set such that the intervals between the six measurement points are equal along the circumferential direction of the outer circumference. Then, at each of the measurement point A1 to the measurement point A6, the surface roughness Rz can be measured along the longitudinal direction of the electrically insulated cable, and the average of the measured values at the six measurement points can be obtained as the average value of the surface roughness Rz of the outer surface 12A of the sheath 12 of the electrically insulated cable.

When a weld line (seam line) formed at the time of the extrusion molding of the sheath 12 can be identified, it is preferable to set the position of the weld as the measurement point A1 and set the measurement point A2 to the measurement point A6 starting from the measurement point A1. The weld line is a line formed when resin joins at an opening portion of a mold or in a mold, and for example, is formed linearly along the longitudinal direction of the electrically insulated cable. In a case in which a plurality of weld lines are observed, it is preferable to set the position of the most visible weld line as the measurement point A1.

The specific method of adjusting the average value of the surface roughness Rz of the outer surface 12A of the sheath 12 is not particularly limited.

For example, the average value of the surface roughness Rz of the outer surface 12A of the sheath 12 can be selected by adjusting the composition ratio of the resin, the heating temperature, or the like and changing the viscosity of the resin when extrusion-molding the resin for sheath onto the surface of the plurality of coated electric wires 11 to form the sheath 12. Also, for example, after the sheath 12 is formed, the outer surface 12A can be processed by polishing or the like to adjust the average value of the surface roughness Rz.

The configuration of the sheath 12 is not particularly limited, and for example, the sheath 12 can be configured by a single layer or can be configured by a plurality of layers as will be described below. It should be noted that from the viewpoint of enhancing the adhesion to a resin used for resin sealing of the electrically insulated cable while enhancing characteristics such as the flame retardancy, it is preferable that the sheath 12 includes an inner sheath 121 an outer sheath 122 as will be described below.

In the following, a configuration example of the inner sheath 121 and the outer sheath 122 will be described.

(Inner Sheath)

For example, although the material of the inner sheath 121 is not particularly limited, a polyolefin-based resin can be used as the material of the inner sheath 121. By using a polyolefin-based resin as the material of the inner sheath 121, it is possible to provide an electrically insulated cable having an excellent flame retardancy.

By using, as the material of the inner sheath 121, a polyolefin-based resin or a resin composition having a polyolefin-based resin as the main component, it is possible to obtain an electrically insulated cable having an excellent flame retardancy even without a large amount of a flame retardant in the outer sheath 122. As a result, the adhesion (thermal fusibility) of the outer sheath 122 to the resin used for the resin sealing can be particularly enhanced.

The inner sheath 121 may not necessarily contain a flame retardant, and even in this case, excellent flame retardancy and adhesion can be achieved. However, it is preferable that the inner sheath 121 include a flame retardant in order to further enhance the flame retardancy and the adhesion for an electrically insulated cable. By including a flame retardant in the inner sheath 121, the amount of flame retardant added to the outer sheath 122 can be reduced, and a further excellent adhesion can be obtained. In addition, mechanical characteristics such as cracking when a low temperature bending test is performed at −40° C. can be prevented.

The flame retardant is not particularly limited, but it is preferable that one or more kinds selected from aluminum hydroxide and magnesium hydroxide are used as the flame retardant.

In a case in which the flame retardant is one or more kinds selected from aluminum hydroxide and magnesium hydroxide, it is preferable to contain 30 parts by mass or more and 120 parts by mass or less of the flame retardant with respect to 100 parts by mass of polyolefin-based resin, in the inner sheath 121. By containing the flame retardant in the above described range, in addition to the above described effects, the electrically insulated cable that is excellent in the abrasion resistance can be obtained. By making the content of the flame retardant greater than or equal to 30 parts by mass, the flame retardancy and the adhesion can be particularly enhanced. Also, it is preferable that the content of the flame retardant is less than or equal to 120 parts by mass, because of being able to particularly enhance the abrasion resistance of the electrically insulated cable.

It is more preferable that the content of the flame retardant in the inner sheath 121 is greater than or equal to 50 parts by mass and less than or equal to 100 parts by mass. By making the content of the flame retardant in the inner sheath 121 in the above described range, the adhesion, the flame retardancy, and the abrasion resistance of the electrically insulated cable can be particularly enhanced.

As the flame retardant contained in the inner sheath 121, aluminum hydroxide and magnesium hydroxide are exemplified, and among these, aluminum hydroxide is particularly preferred of having a large flame retardancy effect.

The size of the flame retardant contained in the inner sheath 121 is not particularly limited, but for example, an average particle size being 0.9 μm or less is preferable because the flame retardancy effect is larger. On the other hand, when the average particle size is too small, the particles tend to agglomerate and become difficult to handle. It is also difficult to obtain. Therefore, it is preferable that the average particle size of the flame retardant is greater than or equal to 0.1 μm and less than or equal to 0.9 μm. It is preferable that the average particle size of the flame retardant is within the above described range, because of being able to obtain an excellent flame retardancy effect without a problem in handling.

It should be noted that in this specification, the average particle size means a particle size at the integrated value of 50% in the particle size distribution determined by the laser diffraction/scattering method.

Examples of the polyolefin-based resin used for the inner sheath 121 include polyethylene, an ethylene-acrylate copolymer such as an ethylene-vinyl acetate copolymer (EVA) or an ethylene-ethyl acrylate copolymer (EEA), an ethylene-α-olefin copolymer, an ethylene-methyl acrylate copolymer, an ethylene-butyl acrylate copolymer, an ethylene-methyl methacrylate copolymer, an ethylene-acrylic acid copolymer, partially saponified EVA, a maleic anhydride modified polyolefin, an ethylene acrylate maleic anhydride copolymer, and the like. A single kind of these resins may be used alone or two or more kinds of these resins may be used in combination.

It is preferable that the polyolefin-based resin used for the inner sheath 121 is one or more kinds selected from an ethylene-vinyl acetate copolymer (EVA) and an ethylene-ethyl acrylate copolymer (EEA). In particular, an ethylene-vinyl acetate copolymer (EVA) is preferable because of having a high mechanical strength and excellent abrasion resistance.

A polyolefin-based resin used in the inner sheath 121 can also contain an acid-modified polymer.

The acid-modified polymer used in this case may be one for which a polyolefin-based resin is graft-modified with carboxylic acid or carboxylic anhydride or a copolymer of an olefin with acrylic acid, maleic anhydride, or the like. However, from the viewpoint of increasing the amount of acid modification, the latter copolymer is preferable.

The inner sheath can also contain a silane coupling agent, and it is preferable to contain 0.1 parts by mass or more and 3 parts by mass or less of the silane coupling agent with respect to 100 parts by mass of the polyolefin-based resin because of being able to enhance the abrasion resistance.

Examples of the silane coupling agent include triethoxyvinyl silane, trimethoxyvinyl silane, 3-methacryloxypropyltrimethoxysilane, 3-aminopropyltrimethoxysilane, 3-aminopropyltriethoxysilane, N-(2-aminoethyl)-3-aminopropyltrimethoxysilane, 3-glycidoxypropyltrimethoxysilane, 3-mercaptopropyltrimethoxysilane, and the like.

(Outer Sheath)

The outer sheath 122 can be composed, for example, of a crosslinked body of a mixture of a thermoplastic polyurethane elastomer and a thermoplastic polyester elastomer or a resin composition mainly containing the mixture. By using the above material for the outer sheath 122, it is possible to particularly enhance the adhesion with PBT (polybutylene terephthalate) and nylon, which are commonly used in resin sealing.

Examples of the thermoplastic polyurethane elastomer include a block copolymer having, as a hard segment, a polyurethane portion composed of a diisocyanate such as MDI (diphenylmethane diisocyanate) or TDI (toluene diisocyanate) and a diol such as ethylene glycol and, as a soft segment, an amorphous polymer such as polyether, polyester, or polycarbonate. Among these, a polyether-based thermoplastic polyurethane elastomer can be preferably used in terms of flexibility, hydrolysis resistance, low-temperature bending properties, and the like.

Also, examples of the thermoplastic polyester elastomer include a block copolymer having, as a hard segment, a crystalline polyester portion such as polybutylene terephthalate or polybutylene naphthalate and, as a soft segment, an amorphous or low crystalline polymer such as polyether or polycaprolactone. Among these, a polyether-based thermoplastic polyester elastomer can be preferably used in terms of flexibility, low-temperature bending characteristics, and the like.

The mixing ratio of the thermoplastic polyurethane elastomer and the thermoplastic polyester elastomer is not particularly limited, but is preferably 20/80 or more and 80/20 or less in the mass ratio. That is, for example, it is preferable that the content of the thermoplastic polyurethane elastomer is greater than or equal to 20 parts by mass and less than or equal to 80 parts by mass.

Increasing the rate of the thermoplastic polyester elastomer enhances the adhesion with a resin used for resin sealing. On the other hand, it is preferable that the rate of the thermoplastic polyurethane elastomer is high in terms of material strength. It is preferable that the mixing ratio of the thermoplastic polyurethane elastomer and the thermoplastic polyester elastomer is in the above described range, because the adhesion with the resin used for resin sealing and the material strength can be made both excellent. It is more preferable that the mixing ratio of the thermoplastic polyurethane elastomer and the thermoplastic polyester elastomer is 40/60 or more and 60/40 or less in the mass ratio. That is, for example, it is more preferable that the content percentage of the thermoplastic polyurethane elastomer is greater than or equal to 40% by mass and less than or equal to 60% by mass.

It is preferable that the outer sheath 122 is crosslinked. This is because the crosslinking can prevent deformation of the outer sheath 122 when the resin sealing (resin molding) is performed after a sensor or the like is connected, and can particularly enhance the durability as an electrically insulated cable to be resin sealed.

As a method of crosslinking the outer sheath, although chemical crosslinking by a crosslinking agent can be used, crosslinking by irradiating the outer sheath with ionizing radial rays is preferable because of having the advantage of easily controlling the degree of crosslinking.

Examples of the ionizing radial rays include high-energy electromagnetic waves such as electron rays, ionizing particle rays, X-rays, and γ-rays, and electron rays are preferable because of being easily controlled and handled.

The outer sheath 122 can contain 3 parts by mass or more and 35 parts by mass or less of one or more kinds of flame retardants selected from metal hydroxides and nitrogen-based flame retardants with respect to 100 parts by mass of the crosslinked body.

By making the content of one or more kinds of flame retardants selected from metal hydroxides and nitrogen-based flame retardants greater than or equal to 3 parts by mass with respect to 100 parts by mass of the crosslinked body, the flame retardancy can be particularly enhanced. Also, by making the content of one or more kinds of flame retardants selected from metal hydroxides and nitrogen-based flame retardants less than or equal to parts by mass with respect to 100 parts by mass of the crosslinked body, the adhesion of the outer sheath 122 to a resin used for resin sealing can be particularly enhanced.

It is more preferable that the flame retardants described above contained in the outer sheath 122 is at 5 parts by mass or more and 22 parts by mass or less with respect to 100 parts by mass of the crosslinking agent.

Examples of the metal hydroxides contained in the outer sheath 122, aluminum hydroxide, magnesium hydroxide, and the like be, and examples of the nitrogen-based flame retardants include melamine, melamine cyanurate, melamine phosphate, and the like, and one or more kinds selected from these can be used. Among these, magnesium hydroxide is preferable as a metal hydroxide, and melamine cyanurate is preferable as a nitrogen-based flame retardant.

To a resin or a resin composition that constitutes the outer sheath or the inner sheath, it is possible to add an antioxidant, a deterioration inhibitor, a colorant, a crosslinking aid, a tackifier, a lubricant, a softener, a filler, a processing aid, a coupling agent, and the like, which are generally blended in a resin.

Examples of the antioxidant include a phenol-based antioxidant, an amine-based antioxidant, a sulfur-based antioxidant, and a phosphorous acid ester-based antioxidant.

Examples of the deterioration inhibitor include a HALS (hindered amine-based light stabilizer), an ultraviolet absorbent, a metal deactivator, a hydrolysis inhibitor, and the like.

Examples of the colorant include carbon black, titanium white, other organic pigments, inorganic pigments, and the like. These can be added for color discrimination or for ultraviolet absorption.

Although it is not necessary to add a crosslinking aid for crosslinking, it is preferable to add 1 parts by mass or more and 10 parts by mass or less a crosslinking aid of with respect to 100 parts by mass of the resin contained in the outer sheath in order to enhance crosslinking efficiency. Examples of the crosslinking aid include triallyl isocyanurate, triallyl cyanurate, trimethylolpropane trimethacrylate, N,N'-metaphenylene bismaleimide, ethylene glycol dimethacrylate, zinc acrylate, zinc methacrylate, and the like.

Examples of the tackifier include a coumarone-indene resin, a polyterpene resins, a xylene formaldehyde resins a hydrogenated rosin, and the like. In addition, as needed, it is possible to add, as a lubricant, fatty acids, unsaturated fatty acids, metal salts thereof, fatty acid amides, fatty acid esters, and the like; as a softener, mineral oil, vegetable oil, plasticizers, and the like; as a filler, calcium carbonate, talc, clay, silica, zinc oxide, molybdenum oxide, and the like; and, as a coupling agent, other than the silane coupling agent described above for the inner sheath, a titanate-based coupling agent such as isopropyltriisostearoyl titanate or isopropyltri (N-aminoethyl-aminoethyl) titanate.

(1-3) Lubricant

The electrically insulated cable 10 in the present embodiment can further include optional members as needed. For example, a lubricant can be included between the coated electric wires 11 and the sheath 12. The adhesion of the sheath 12 to the coated electric wires 11 can be adjusted by arranging a lubricant between the coated electric wires 11 and the sheath 12. By arranging a lubricant, the peelability of the sheath 12 from the coated electric wires 11 can be enhanced, and the workability when connecting a connector or the like to an end portion of the electrically insulated cable can be enhanced.

The material of the lubricant is not particularly limited, but for example, talc or the like can be used.

(2) Shape and Characteristics of Electrically Insulated Cable

The size of the electrically insulated cable according to the present embodiment is not particularly limited, but it is preferable that the outer diameter D is 3.0 mm or more and 6.0 mm or less.

By making the outer diameter D greater than or equal to 3.0 mm, even in a case in which the surface roughness Rz of the outer surface 12A of the sheath 12 is large, the roughness of the surface is not noticeable and the appearance can be made favorable. In addition, the dimensional accuracy can be enhanced.

In a case in which the outer diameter D of the electrically insulated cable is 6.0 mm or less, the surface area of the outer surface 12A of the sheath 12 is normally small, and the adhesion with a resin used for resin sealing easily decreases. However, in the electrically insulated cable according to the present embodiment, even in a case in which the outer diameter D of the electrically insulated cable is 6.0 mm or less, the adhesion with the resin used for resin sealing can be enhanced, and thus, the electrically insulated cable can be particularly effective.

The outer diameter D of the electrically insulated cable can be measured using a micrometer.

In an electrically insulated cable according to the present embodiment, it is preferable that a sheath has a fusion strength of 50 N/cm or more and more than 60 N/cm as will be defined below.

By making the fusion strength greater than or equal to 50 N/cm, the adhesion with a resin and the resin used for resin sealing can be sufficiently enhanced, and the waterproofness can be enhanced.

In the electrically insulated cable according to the present embodiment, the fusion strength of the sheath is preferably 93 N/cm or less, and is more preferably 90 N/cm or less.

In a case in which the fusion strength is 93 N/cm or less, the dimensional accuracy can be enhanced and the abrasion resistance can be enhanced.

Figure 3:
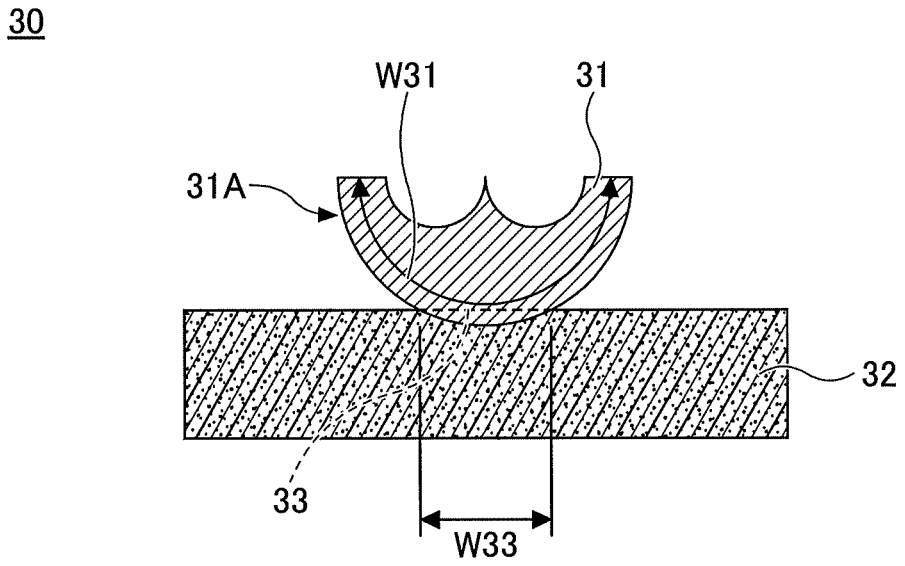
FIG. 3 is an explanatory view of a fusion strength evaluation sample.

The fusion strength can be defined as follows. FIG. 3 illustrates a fusion strength evaluation sample 30 prepared at the time of evaluating the fusion strength. FIG. 3 illustrates a cross-sectional view of the fusion strength evaluation sample 30 in a plane perpendicular to the longitudinal direction of a sheath 31. As illustrated in FIG. 3, the sheath is separated from the coated electric wires of the electrically insulated cable according to the present embodiment, and an outer surface 31A of the sheath 31 separated from the plurality of coated electric wires is thermally fused to a sheet 32 of polybutylene terephthalate (PBT) to prepare the fusion strength evaluation sample 30. Then, when a peel test is performed on the fusion strength evaluation sample, the maximum peel strength is converted to a value per 1 cm of a width W33 of a fusion surface 33 between the sheath 31 and the sheet 32 included in the fusion strength evaluation sample and the value can be defined as the fusion strength.

The fusion strength evaluation sample 30 can be prepared by thermally fusing the outer surface 31A of the sheath 31 separated from the plurality of coated electric wires to the sheet 32, by pressing at 230° C. for 30 seconds at 1.96 MPa. The peel test can be a 180 degree peel test with a tensile speed of 50 mm/min.

2. Harness Integrated with Sensor

Figure 2:
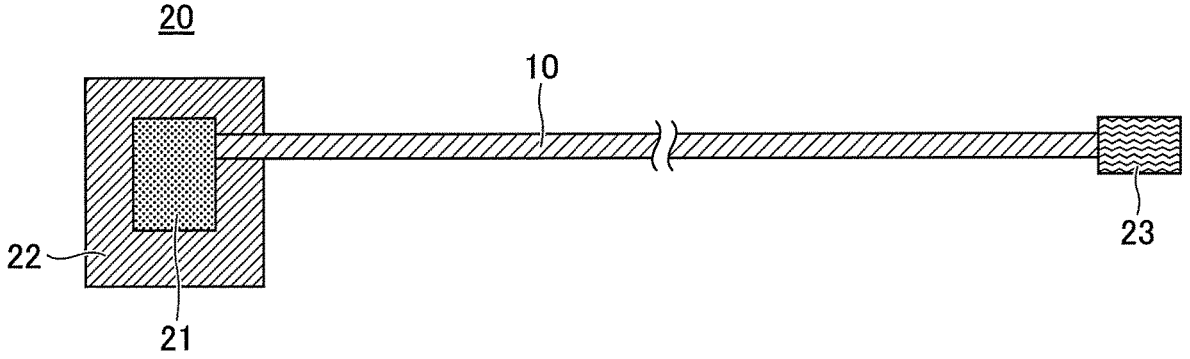
FIG. 2 is an explanatory view of a harness integrated with sensor according to one aspect of the present disclosure.

As illustrated in FIG. 2, the harness integrated with sensor 20 according to the present embodiment includes the electrically insulated cable 10 described above, a sensor 21 connected to the electrically insulated cable 10, and a housing 22 that collectively seals at least a portion of the electrically insulated cable 10 and the sensor 21.

The harness integrated with sensor 20 according to the present embodiment includes an electrically insulated cable 10 described above. The sensor 21 is connected to the electrically insulated cable 10. FIG. 2 illustrates a configuration in which the sensor 21 is connected to one end portion of the electrically insulated cable 10, but it is not limited to such a configuration. The sensor 21 may be connected, for example, in the middle or the like of the electrically insulated cable.

Then, the harness integrated with sensor 20 according to the present embodiment includes the sensor 21, and the housing 22 that collectively seals at least a portion of the electrically insulated cable 10 and the sensor 21. The housing 22 is a resin molded body and can be formed by resin-sealing the sensor 21 and the electrically insulated cable 10 together.

The type of the sensor 21 is not particularly limited, and various sensors such as a wheel speed sensor required to be protected by the housing 22 can be used.

The resin used for the housing 22 is not particularly limited, and, for example, one or more kinds selected from polybutylene terephthalate, nylon, and the like can be used as the resin used for the housing 22.

On the other end portion of the electrically insulated cable 10 that is not connected to the sensor 21, a connector 23 or the like can be arranged as needed.

Because the harness integrated with sensor 20 according to the present embodiment includes the electrically insulated cable 10 described above, the adhesion between the resin used for the housing 22 and the electrically insulated cable 10 is excellent. Therefore, the harness integrated with sensor 20 according to the present embodiment is excellent in waterproofing of the sensor 21 portion, and it is possible to suppress a failure or the like of the sensor from occurring.

Although the embodiment has been described in detail above, it is not limited to a specific embodiment. Various modifications and changes can be made within a scope set forth in claims.

EXAMPLES

Although specific Examples will be described below, the present invention is not limited to these Examples.

(Evaluation Method)

First, the methods of evaluating electrically insulated cables prepared in Experimental Examples below will be described.

(1) Surface Roughness Rz

The surface roughness Rz was performed using a surface roughness measuring machine (SURFTEST SV-2100 manufactured by Mitutoyo Corporation).

In a cross-section perpendicular to the longitudinal direction of the electrically insulated cable prepared in each Experimental Example described below, the surface roughness Rz was measured at six measurement points arranged along the circumferential direction. Then, the average value of the surface roughness Rz at the six measurement points was defined as the average value of the surface roughness Rz of the electrically insulated cable of the Experimental Example. It should be noted that, in Table 1, the average value of the surface roughness Rz evaluated in each Experimental Example is indicated in the section for "SURFACE ROUGHNESS Rz".

In setting the six measurement points, first, the measurement point A1 was set at the position of the weld line in a cross section perpendicular to the longitudinal direction of the electrically insulated cable. Then, as illustrated in FIG. 1, starting from the measurement point A1, the measurement point A2 to the measurement point A6 were arranged such that the six measurement points were equally spaced along the outer circumference of the cross-section of the electrically insulated cable.

At the six measurement points that are the measurements points A1 to A6, a reference length was taken along the longitudinal direction of the electrically insulated cable, that is, the direction perpendicular to the paper surface in FIG. 1, and measurement was performed in accordance with JIS B 0601 (2013).

(2) Fusion Strength

For each Experimental Example, as illustrated in FIG. 3, the sheath was separated at a width of 5 mm from the coated electric wires of the electrically insulated cable, and the outer surface 31A of the separated sheath 31 was thermally fused to the sheet 32 of polybutylene terephthalate by pressing at 230° C. at 1.96 MPa for 30 seconds. By thermally fusing the sheath 31 to the sheet 32, the fusion strength evaluation sample 30 was prepared and then it was air-cooled.

It should be noted that separating the sheath at a width of 5 mm from the coated electric wires of the electrically insulated cable means that the sheath 31 is cut out such that the width W31 of the outer surface of the sheath 31 A separated from coated electric wires of the electrically insulated cable is 5 mm.

Thereafter, with respect to the fusion strength evaluation sample 30, a 180 degree peel test between the sheath 31 and the sheet 32 of polybutylene terephthalate was performed at a tensile rate of 50 mm/min to measure the maximum peel strength. Then, the maximum peel strength was converted per 1 cm of the width W33 of the fusion surface 33 between the sheath 31 and the sheet 32 included in the fusion strength evaluation sample 30 to the fusion strength. One with 50 N/cm or more was determined as acceptable.

(3) Dimensional Accuracy

In a cross-section perpendicular to the longitudinal direction of the electrically insulated cable prepared in each Experimental Example described below, the outer diameter of the electrically insulated cable was measured using a micrometer.

Then, the outer diameter of a measured electrically insulated cable was evaluated as A when the variation amount from a predetermined standard dimension was 1% or less, that is, when the outer diameter variation was at a margin of error; B when the outer diameter variation was greater than 1% and 2.2% or less; C when the outer diameter variation was greater than 2.2% and 2.5% or less; and D when the outer diameter variation was greater than 2.5%.

It should be noted that in Experimental Examples described below, the standard dimension is 4 mm. For example, when the outer diameter variation is 1% or less, the outer diameter of the electrically insulated cable is within 4±0.04 mm.

(4) Abrasion Resistance

The abrasion resistance of the cable was measured in accordance with "12. abrasion resistance test, (1) abrasion tape method" of heat-resistant constant voltage electric wires for automobiles of JASO D 608-92.

When the evaluation result was 12 m or more, it was evaluated as A, when it was 10 m or more and less than 12 m, it was evaluated as B, and when it was less than 10 m, it was evaluated as C.

In the following, electrically insulated cables in respective Experimental Examples will be described below. Experimental Example 1 to Experimental Example 6 are Examples and Experimental Example 7 are Comparative Examples.

Experimental Example 1

By the following procedure, an electrically insulated cable having the structure illustrated in FIG. 1 was in a cross-section perpendicular to the longitudinal direction was prepared.

(Preparation of Material for Outer Sheath)

50 parts by mass of a thermoplastic polyurethane elastomer, 50 parts by mass of a thermoplastic polyester elastomer, 5 parts by mass of a crosslinking aid, and 10 parts by mass of magnesium hydroxide were melted and mixed using a biaxial mixer (barrel diameter 45 mm, L/D=32). Then, a discharge strand of the molten mixture was pelletized by a method of water-cooling cutting to obtain a material for an outer sheath.

As the thermoplastic polyurethane elastomer, a polyether-based elastomer having a JIS A hardness of 85 and a glass transition point of −50° C. was used.

As the thermoplastic polyester elastomer, a polyether-based elastomer having a Shore D hardness of 40 and a melting point of 160° C. was used.

As the crosslinking aid, trimethylolpropane trimethacrylate was used, and as magnesium hydroxide, one having an average particle size of 0.8 μm was used.

(Preparation of Material for Inner Sheath)

100 parts by mass of an ethylene vinyl acetate copolymer and 100 parts by mass of magnesium hydroxide were melted and mixed using a biaxial mixer (barrel diameter 45 mm, L/D=32), and a discharge strand of the molten mixture was pelletized by a method of water-cooling cutting to obtain a material for an inner sheath.

As the ethylene-vinyl acetate copolymer, one whose content of vinyl acetate was 25% by mass was used and as magnesium hydroxide, one having an average particle size of 0.8 μm was used.

(Preparation of Material for Coated Electric Wire)

A composition of the material for coated electric wires was melted and mixed using a biaxial mixer (barrel diameter of 45 mm, L/D=32), and a discharge strand was pelletized by a method of water-cooling cutting.

The composition of the material for coated electric wires contains 100 parts by mass of linear low density polyethylene (LLDPE), 80 parts by mass of magnesium hydroxide, which is a flame retardant, 0.5 parts by mass of Irganox 1010 (Chiba Specialty Chemicals), which is an antioxidant, and 3 parts by mass of trimethylol propane trimethacrylate.

For LLDPE, one having a melting point of 122° C. and a melt flow rate of 1.0 was used.

For magnesium hydroxide, one having an average particle size of 0.8 μm and a BET specific surface area of 8 $m^2/g$ was used.

(Preparation of Coated Electric Wire)

A short axial extruder (cylinder diameter of 30 mm, L/D=24) was used to extrude and coat a pellet of the material for coated electric wires on a stranded conductor having a cross-sectional area of 0.35 $mm^2$ such that the average thickness was 0.30 mm, and then it was irradiated with an electron ray to manufacture a coated electric wire.

(Manufacturing of Electrically Insulated Cable)

Two prepared coated electric wires were twisted together at a twist pitch of 30 mm to form a twist pair, and on their outer peripheries, the material for the inner sheath descried above was extruded and coated using a single-axial extruder (barrel diameter of 50 mm, L/D=24) such that the outer diameter was 3.4 mm. Then, the same extruder (barrel diameter of 50 mm, L/D=24) was used to extrude and coat the material for the outer sheath on the outer periphery of the inner sheath such that the outer diameter was 4.0 mm and then it was irradiated with an electron ray.

The obtained electrically insulated cable was evaluated as described above. The evaluation results are indicated in Table 1.

Experimental Example 2

With the exception that the surface of the sheath was polished with an abrasion tape of #3000 after the material for the outer sheath was extruded and coated and it was irradiated with an electron ray, an electrically insulated cable was prepared and evaluated similarly to Experimental Example 1.

The evaluation results are indicated in Table 1.

Experimental Example 3

With the exception that the surface of the sheath was polished with an abrasion tape of #1500 after the material for the outer sheath was extruded and coated and it was irradiated with an electron ray, an electrically insulated cable was prepared and evaluated similarly to Experimental Example 1.

The evaluation results are indicated in Table 1.

Experimental Example 4

With the exception that the surface of the sheath was polished with an abrasion tape of #280 after the material for the outer sheath was extruded and coated and it was irradiated with an electron ray, an electrically insulated cable was prepared and evaluated similarly to Experimental Example 1.

The evaluation results are indicated in Table 1.

Experimental Example 5

With the exception that the surface of the sheath was polished with an abrasion tape of #240 after the material for the outer sheath was extruded and coated and it was irradiated with an electron ray, an electrically insulated cable was prepared and evaluated similarly to Experimental Example 1.

The evaluation results are indicated in Table 1.

Experimental Example 6

With the exception that the surface of the sheath was polished with an abrasion tape of #180 after the material for the outer sheath was extruded and coated and it was irradiated with an electron ray, an electrically insulated cable was prepared and evaluated similarly to Experimental Example 1.

The evaluation results are indicated in Table 1.

Experimental Example 7

With the exception that the surface of the sheath was polished with an abrasion tape of #150 after the material for the outer sheath was extruded and coated and it was irradiated with an electron ray, an electrically insulated cable was prepared and evaluated similarly to Experimental Example 1.

The evaluation results are indicated in Table 1.

TABLE 1

| | Experimental Example 1 | Experimental Example 2 | Experimental Example 3 | Experimental Example 4 | Experimental Example 5 | Experimental Example 6 | Experimental Example 7 |
|---|---|---|---|---|---|---|---|
| SURFACE ROUGHNESS Rz (μm) | 15 | 20 | 25 | 60 | 65 | 75 | 88 |
| FUSION STRENGTH (N/cm) | 55 | 66 | 82 | 87 | 91 | 92 | 94 |
| DIMENSIONAL ACCURACY | A | A | B | B | B | C | D |
| ABRASION RESISTANCE | A | A | A | B | B | B | C |

According to the results indicated in Table 1, for each of the electrical insulating cables of Experimental Example 1 to Experimental Example 6 in which the average value of surface roughness Rz was 15 μm or more and 75 μm or less, it could be confirmed that the fusion strength of the sheath was 50 N/cm or more and the adhesion with the resin used for resin sealing was excellent. Therefore, it could be confirmed that the waterproofness of the housing portion is excellent when making a harness integrated with sensor.

Also, it could be confirmed that the electrically insulated cables of Experimental Example 1 to Experimental Example 6 were evaluated as A to C for the dimensional accuracy and were evaluated as A or B for the abrasion resistance, and the manufactured electrically insulated cables were excellent in the dimensional accuracy and the abrasion resistance.

DESCRIPTION OF THE REFERENCE NUMERALS

10 electrically insulated cable
11 coated electric wire
111 conductor
112 coating layer
12 sheath
121 inner sheath
122 outer sheath
12A outer surface
D outer diameter
A1 to A6 measurement point
20 harness integrated with sensor
21 sensor
22 housing
23 connector
30 fusion strength evaluation sample
31 sheath
31A outer surface
32 sheet
33 fusion surface
W31 width
W33 width

The invention claimed is:

1. An electrically insulated cable comprising:

a plurality of coated electric wires and a sheath covering outer peripheries of the plurality of coated electric wires, wherein an average value of surface roughness Rz of an outer surface of the sheath is 15 μm or more and 75 μm or less, wherein when a peel test is performed on a fusion strength evaluation sample obtained by thermally fusing the outer surface of the sheath separated from the plurality of coated electric wires to a sheet of polybutylene terephthalate, a maximum peel strength is converted to a value per 1 cm of a width of a fusion surface between the sheath and the sheet of polybutylene terephthalate included in the fusion strength evaluation sample and the value is defined as a fusion strength of the sheath, and wherein the fusion strength of the sheath is 50 N/cm or more.

2. The electrically insulated cable according to claim 1, wherein an outer diameter is 3.0 mm or more and 6.0 mm or less.

3. A harness integrated with sensor comprising:

the electrically insulated cable according to claim 1;

a sensor connected to the electrically insulated cable; and a housing that collectively seals at least a portion of the electrically insulated cable and the sensor.

4. The electrically insulated cable according to claim 1, wherein the sheath includes an inner sheath covering the outer peripheries of the coated electric wires and an outer sheath covering an outer periphery of the inner sheath, wherein the inner sheath contains a polyolefin-based resin and a first flame retardant, wherein the first flame retardant is one or more kinds selected from aluminum hydroxide and magnesium hydroxide, wherein a content of the first flame retardant in the inner sheath is 30 parts by mass or more and 120 parts by mass or less with respect to 100 parts by mass of the polyolefin-based resin, and wherein the first flame retardant has an average particle size of 0.1 μm or more and 0.9 μm or less.

5. The electrically insulated cable according to claim 4, wherein the outer sheath contains a crosslinked body of a resin composition and contains a second flame retardant, wherein the second flame retardant is one or more kinds selected from metal hydroxides and nitrogen-based flame retardants, and wherein a content of the second flame retardant in the outer sheath is 3 parts by mass or more and 35 parts by mass or less with respect to 100 parts by mass of the crosslinked body of the resin composition.

* * * * *